US006894669B2

(12) United States Patent
Suzuki et al.

(10) Patent No.: US 6,894,669 B2
(45) Date of Patent: May 17, 2005

(54) DISPLAY CONTROL DEVICE OF LIQUID CRYSTAL PANEL AND LIQUID CRYSTAL DISPLAY DEVICE

(75) Inventors: Toshiaki Suzuki, Kawasaki (JP); Koichi Katagawa, Kawasaki (JP); Koshu Yonemura, Kawasaki (JP); Toshihiro Kojima, Kawasaki (JP); Takashi Yuda, Kawasaki (JP)

(73) Assignee: Fujitsu Display Technologies Corporation, Kawasaki (JP)

( * ) Notice: Subject to any disclaimer, the term of this patent is extended or adjusted under 35 U.S.C. 154(b) by 322 days.

(21) Appl. No.: 10/260,364

(22) Filed: Sep. 30, 2002

(65) Prior Publication Data

US 2003/0156092 A1 Aug. 21, 2003

(30) Foreign Application Priority Data

Feb. 20, 2002 (JP) ..... 2002-043526

(51) Int. Cl.[7] ..... G09G 3/36

(52) U.S. Cl. ..... 345/87; 345/690; 345/204; 345/101; 345/94; 345/208

(58) Field of Search ..... 345/87–104, 208–210, 345/204, 690

(56) References Cited

U.S. PATENT DOCUMENTS 6,329,980 B1 * 12/2001 Uehara et al. ..... 345/204
6,501,451 B1 * 12/2002 Sakashita ..... 345/87
6,556,180 B1 * 4/2003 Furuhashi et al. ..... 345/87
6,791,525 B2 * 9/2004 Matsumura et al. ..... 345/100
2002/0024481 A1 * 2/2002 Kawabe et al. ..... 345/87
2002/0196224 A1 * 12/2002 Ham ..... 345/94

FOREIGN PATENT DOCUMENTS

JP 2001-125067 5/2001

* cited by examiner

*Primary Examiner*—Lun-Yi Lao
(74) *Attorney, Agent, or Firm*—Greer, Burns & Crain, Ltd.

(57) ABSTRACT

An operational unit determines, for subfield(s) other than a last subfield of a plurality of subfields constituting a single frame period, based on a difference determined by a data comparison unit, exceeded display data for setting the transmittance of each pixel to a value exceeding a target transmittance corresponding to image data supplied anew. The operational unit also determines, for the last subfield of the single frame period, based on the difference determined by the data comparison unit, target display data for setting the transmittance of each pixel to the target transmittance. An overshoot operation or operations are performed within the single frame period, and each pixel is set to the transmittance corresponding to the image data. This makes it possible to avoid trails occurring in moving image display and enhance the appearance of moving image display with no increase in frame rate.

11 Claims, 9 Drawing Sheets

DISPLAY CONTROL DEVICE OF LIQUID CRYSTAL PANEL AND LIQUID CRYSTAL DISPLAY DEVICE

BACKGROUND OF THE INVENTION

1. Field of the Invention

The present invention relates to a display control device of a liquid crystal panel for controlling display data to be displayed on the liquid crystal panel, and a liquid crystal display device.

2. Description of the Related Art

Liquid crystal display devices are low in power consumption and compact in size, and thus are widely adopted in personal computers, television sets, and so on. In a liquid crystal display device, an electric field applied to each liquid crystal cell (pixel) of the liquid crystal panel is adjusted to change the transmittance of the liquid crystal cell for image display. Liquid crystal cells vary in transmittance relatively slowly. Consequently, in displaying moving images in particular, blurs in which data of previous frames appears overlapped (image trails) tend to occur. This phenomenon is unique to liquid crystal display devices, not seen in CRTs (Cathode Ray Tubes).

To reduce trails and bring the moving image display performance close to that of CRTs, there has been developed a technology called an impulse drive system which imitates the waveforms of applied voltages in CRTs. In addition, even in the case of a conventional hold drive system, techniques named as an overdrive method and an overshoot method have been developed for the sake of improved moving image display performance. Here, the hold drive system refers to a technology in which signals corresponding to the same image data are output to the liquid crystal cells over a period of one frame.

An overview of the overdrive method and overshoot method has been disclosed, for example, in FIG. 3 of Japanese Unexamined Patent Application Publication No. 2001-125067. The overdrive method is a technique for writing more emphasized data signals than the data signals corresponding to pixel data for actual display, to the liquid crystal cells (overdrive) so that the liquid crystal cells reach their target values in transmittance within a single frame period. The overshoot system is a technique for emphasizing the data signals further so that the liquid crystal cells change in transmittance to exceed their target values within a single frame period (overshoot), and for restoring the transmittances to the target values in the next one frame period.

In the foregoing overshoot method, greater emphasis on the data signals accelerate the changes of transmittance (pixel response) with an improvement in the moving image display performance. The more the data signals are emphasized, however, the greater the differences between the target transmittances corresponding to the input image data and the emphasized transmittances become. This results in a higher propensity to new trails, sometimes deteriorating the appearance of so-called moving image display. The trails resulting from overshoot occur depending on the display pattern. That is, when the overshoot method is employed, it is impossible to enhance the appearance of moving image display in all display patterns.

SUMMARY OF THE INVENTION

It is an object of the present invention to improve the moving image display performance of a liquid crystal display device. In particular, the improvement in the moving image display performance is intended of a liquid crystal panel for hold drive.

According to one of the aspects of the present invention, a data memory unit stores image data to be supplied correspondingly to each single frame period for which a single frame of a liquid crystal panel is displayed. A data comparison unit determines, on each pixel of the liquid crystal panel, a difference between image data supplied anew and image data of a frame immediately preceding and stored in the data memory unit.

A timing control unit generates timing signals synchronizing with respective subfields. The timing control unit also receives display data from an operational unit in succession, and outputs driving signals according to the received display data in synchronization with the timing signals.

The operational unit determines, for subfield(s) of a plurality of subfields other than a last subfield, based on the difference determined by the data comparison unit, exceeded display data for setting the transmittance of each pixel to a value exceeding a target transmittance corresponding to image data supplied anew, the plurality of subfields constituting the single frame period. That is, an overshoot operation or operations are performed in the subfields except the last subfield. Then, transmittance of each pixel changes to the transmittance which allows the supplied image data to be emphasized, whereby a displayed image will be more emphasized than the supplied image data.

The operational unit also determines, for the last subfield of the single frame period, based on the difference determined by the data comparison unit, target display data for setting the transmittance of each pixel to the target transmittance. Consequently, in the last subfield, the transmittance of each pixel changes to the transmittance corresponding to the supplied image data.

Since an overshoot operation or operations are performed within a single frame period and the transmittance of each pixel is set to the transmittance corresponding to the image data, it is possible to avoid trails in moving image display. In particular, trails resulting from overshoot operations can be avoided. In other words, overshoot operations causing no trail can be made without increasing the frame rate (at the same frame rates as heretofore).

Since the transmittance of each pixel changes to its target value within a single frame period, it is possible to enhance the appearance of moving image display in any display pattern and improve the moving image display performance.

According to another aspect of the present invention, the target display data which the operational unit determines for the last subfield corresponds to an exceeded applied voltage. The exceeded applied voltage exceeds a target applied voltage to be applied to the liquid crystal panel so as to set each pixel to the target transmittance. That is, an overdrive operation is performed in the last subfield. The transmittance of each pixel can thus be changed to the transmittance corresponding to the image data in a single frame period with reliability.

According to another aspect of the present invention, the display data for use in the last subfield is held in a first memory unit so that the operational unit need not hold the display data. This can simplify the circuits of the operational unit. In addition, holding the display data in the form of differences can reduce the amount of data to be held. As a result, the first memory unit can be made smaller in memory capacity.

According to an other aspect of the present invention, the display data for use in the intermediate subfield(s) exclusive of the first and last subfields is held in a second memory unit so that the operational unit need not hold the display data. This can simplify the circuits of the operational unit. In addition, holding the display data in the form of differences can reduce the amount of data to be held. As a result, the second memory unit can be made smaller in memory capacity.

According to another aspect of the present invention, the operational unit generates the exceeded display data and the target display data which allow an average of transmittance in the single frame period to be substantially equal to the target transmittance. In other words, the exceeded display data and the target display data are generated so as to make the time integral of the actual transmittance and the time integral of the target value of the transmittance equal to each other. Adjusting the average of the transmittance in a single frame period to the target value can achieve constant hues in displaying moving image data, resulting in improved display properties of moving images.

According to another aspect of the present invention, a maximum value of the target transmittance is set to be smaller than a transmittance corresponding to a maximum value of the exceeded display data which the operational unit is able to output. On this account, image data corresponding to the maximum transmittance can be displayed with no differences in luminance between moving images and still images. Consequently, even if an overshoot operation or operations are performed in a single frame period and the pixels are changed between target values in transmittance, it is possible to eliminate differences in display properties between still images and moving images.

According to another aspect of the present invention, lengths of periods of the subfields are set to be equal to each other. This allows the operational unit and the timing control unit to operate at the same timing in every subfield. The operational unit and the timing control unit can thus be simplified in circuitry.

According to another aspect of the present invention, a length of the period of the first subfield of the single frame period is set to be shorter than lengths of the periods of the rest of the subfields. The liquid crystal cells can thus make quick changes in transmittance toward their target values during the first subfield after frame switching. Consequently, moving image data and still image data can be displayed at the same hues with improved display properties.

According to another aspect of the present invention, the display control device of a liquid crystal panel comprises a temperature detecting unit for detecting an ambient temperature of the liquid crystal panel, and a temperature memory unit. The temperature memory unit contains temperature correcting values corresponding to individual ambient temperatures to be detected by the temperature detecting unit.

First and second operational units correct the exceeded display data and the target display data according to the temperature correcting values which are output from the temperature memory unit in response to the ambient temperature detected by the temperature detecting unit. Consequently, optimum applied voltages can be supplied to the liquid crystal panel all the time regardless of changes in the environment, improving the display quality of the liquid crystal panel.

According to another aspect of the present invention, the display control device of a liquid crystal panel comprises a rate detecting unit for detecting a frame rate, which is the single frame period, and a rate memory unit. The rate memory unit contains rate correcting values corresponding to frame rates to be detected by the rate detecting unit.

The first and second operational units correct the exceeded display data and the target display data according to the rate correcting values which are output from the rate memory unit corresponding to the frame rate detected by the rate detecting unit. Consequently, optimum applied voltages can be supplied to the liquid crystal panel all the time regardless of frame rate changes, improving the display quality of the liquid crystal panel.

BRIEF DESCRIPTION OF THE DRAWINGS

The nature, principle, and utility of the invention will become more apparent from the following detailed description when read in conjunction with the accompanying drawings in which like parts are designated by identical reference numbers, in which.

DESCRIPTION OF THE PREFERRED EMBODIMENTS

Hereinafter, embodiments of the present invention will be described with reference to the drawings.

Figure 1:
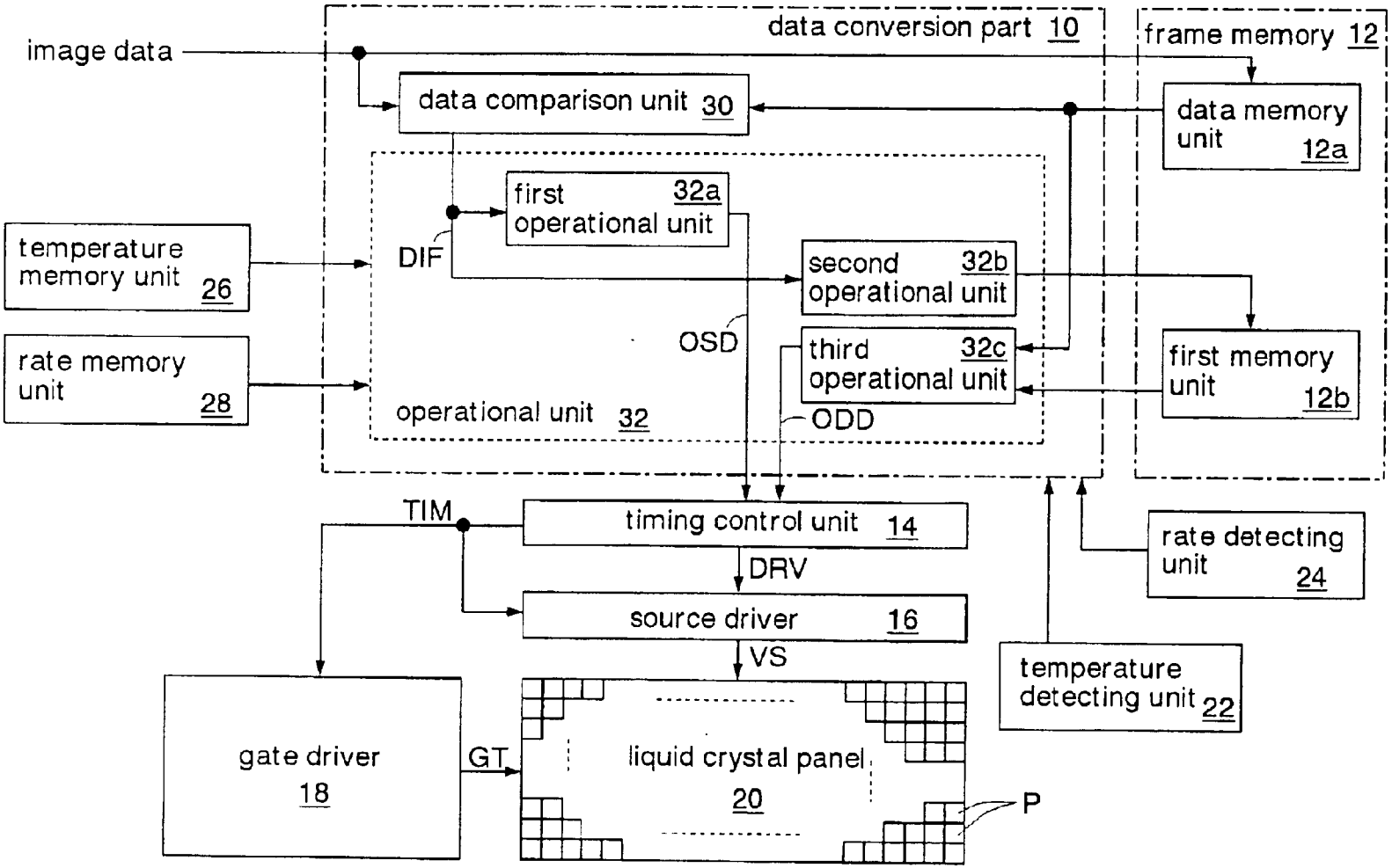
FIG. 1 is a block diagram showing a first embodiment of the present invention.

FIG. 1 shows a first embodiment of the display control device of a liquid crystal panel and the liquid crystal display device according to the present invention.

The liquid crystal display device comprises a data conversion part 10, a frame memory 12, a timing control unit 14, a source driver 16, a gate driver 18, a liquid crystal panel 20, a temperature detecting unit 22, a rate detecting unit 22, a temperature memory unit 26, and a rate memory unit 28. The data conversion part 10, frame memory 12, timing control unit 14, source driver 16, gate driver 18, temperature detecting unit 22, rate detecting unit 24, temperature memory unit 26, and rate memory unit 28 function as a display control device for displaying images on the liquid crystal panel.

The liquid crystal display device of this embodiment operates on hold drive. That is, data signals corresponding to the same image data are supplied to the liquid crystal cells over a period of one frame (16.6 ms) for displaying a single frame of the liquid crystal panel. Besides, each single frame period is divided into two subfields SF1 and SF2 (8.3 ms each) by the timing control unit 14.

The data conversion part 10 is formed as an ASIC (Application Specific IC), and has a data comparison unit 30 and an operational unit 32. The data comparison unit 30 compares image data supplied anew and image data stored last time in a data memory unit 12*a* of the frame memory 12 frame by frame, and outputs the difference in data as a difference signal DIF pixel by pixel. After the comparison by the data comparison unit 30, the data memory unit 12*a* is overwritten with the image data supplied anew.

The operational unit 32 includes a first operational unit 32*a*, a second operational unit 32*b*, and a third operational unit 32*c*. The first operational unit 32*a* generates display data for the subfield SF1. The second and third operational units 32*b* and 32*c* generate display data for the subfield SF2.

The first operational unit 32*a* determines, simultaneously with the start of the subfield SF1, an overshoot value pixel by pixel based on the difference signal DIF from the data comparison unit 30, and outputs the determined value as display data OSD. Here, the overshoot refers to the driving method for displaying supplied image data with emphasis. That is, the display data OSD exceeds display data for setting the transmittances of the liquid crystal cells to a value greater or smaller than the transmittances corresponding to the image data (target transmittances).

The second operational unit 32*b* initially determines an overdrive value pixel by pixel based on the difference signal DIF from the data comparison unit 30. Here, the overdrive refers to the driving method for changing the transmittances of the liquid crystal cells to target transmittances corresponding to the image data in a short time. Here, applied voltages to be supplied to the liquid crystal cells are slightly higher or lower than the applied voltages VS corresponding to the target transmittances (target applied voltages). That is, display data ODD is target display data for setting the applied voltages VS to a value greater or smaller than the target applied voltages corresponding to the image data so that the transmittances of the liquid crystal cells become the target transmittances.

The second operational unit 32*b* determines differences between the overdrive values determined and the target values corresponding to image data supplied anew, and writes the differences determined to a first memory unit 12*b* of the frame memory 12 as difference data. The third operational unit 32*c* restores, simultaneously with the start of the subfield SF2, the overdrive values for use in the subfield SF2 from the image data written to the data memory unit 12*a* after the comparison by the data comparison unit 30 and the difference data stored in the first memory unit 12*b*, and outputs the resultants as the display data ODD (target display data).

In this way, the image information for use in the subfield SF2 is held in the first memory unit 12*b* so that the operational unit 32 need not hold the image information. The operational unit 32 is thus simplified in circuitry. Moreover, holding the image information in the form of differences can reduce the amount of information to be held. Consequently, the first memory unit 12*b* can be made smaller in memory capacity.

The timing control unit 14 successively receives the display data OSD and ODD from the first operational unit 32*a* and the third operational unit 32*c*, respectively, and outputs these display data OSD and ODD to the source driver 16 as driving signals DRV. The timing control unit 14 also generates a plurality of timing signals TIM for operating the source driver 16 and the gate driver 18 for the subfields SF1 and SF2, respectively.

The source driver 16 generates, according to the driving signals DRV from the timing control unit 14, the applied voltages VS to be supplied to pixels P (liquid crystal cells) of the liquid crystal panel in synchronization with the timing signals TIM. The gate driver 18 generates gate signals GT for selecting pixels P of the liquid crystal panel in synchronization with the timing signals TIM. The liquid crystal panel 20 has a plurality of pixels P which are formed in a matrix.

The temperature detecting unit 22 detects the ambient temperature of the liquid crystal panel 20 and outputs the detected temperature to the data conversion part 10. The rate detecting unit 24 detects the frame rate (vertical synchronizing signal), which is the period where a single frame of the liquid crystal panel 20 is displayed, and outputs the detected frame rate to the data conversion part 10.

The temperature memory unit 26 is formed in a predetermined area of a not-shown ROM (Read Only Memory), and contains temperature correcting values corresponding to individual ambient temperatures of the liquid crystal panel 20. For example, the temperature memory unit 26 is provided with a temperature correcting value table. The operational unit 32 reads a temperature correcting value corresponding to the result of detection of the temperature detecting unit 22 from the temperature memory unit 26, and corrects the display data OSD and ODD according to the ambient temperature of the liquid crystal panel 20.

The rate memory unit 28 is formed in a predetermined area of a not-shown ROM, and contains rate correcting values corresponding to individual frame rates. For example, the rate memory unit 28 is provided with a rate correcting value table. The operational unit 32 reads a rate correcting value corresponding to the result of detection of the rate detecting unit 24 from the rate memory unit 28, and corrects the display data OSD and ODD according to the frame rate. The temperature memory unit 26 and the rate memory unit 28 may be allocated to different areas of an identical ROM, or may be formed as different ROMs.

The operational unit 32 thus corrects the display data OSD and ODD according to the temperature change and frame rate of the liquid crystal panel 20. Consequently, optimum applied voltages VS can be supplied to the liquid crystal panel 20 all the time regardless of changes in the environment and changes in frame rate, allowing an improvement to the display quality of the liquid crystal panel 20.

Figure 2:
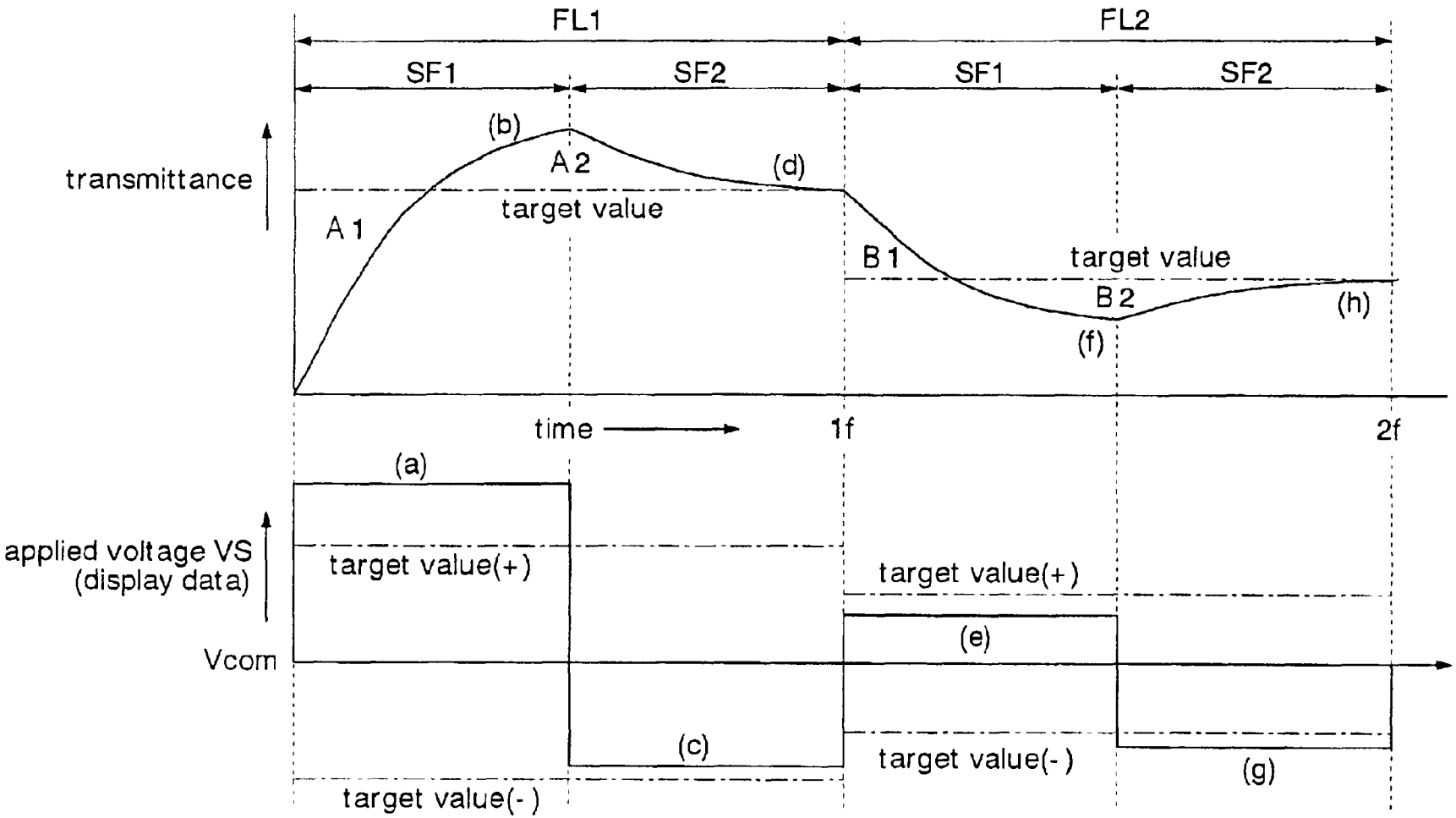
FIG. 2 is a timing chart showing how data is written to a pixel in the operation of the first embodiment.

FIG. 2 shows how a single pixel (liquid crystal cell) of the liquid crystal panel is written with data in the liquid crystal display device of the first embodiment. In this example, image data to increase the transmittance (e.g., data to increase luminance) is supplied for a frame period FL1, and image data to decrease the transmittance (e.g., data to decrease luminance) is supplied for a frame period FL2. The alternate long and short dash lines in the diagram indicate the target values of the transmittance and the target values of the applied voltage VS (target applied voltages) in the respective frame periods. The applied voltage VS is inverted in polarity upon each subfield scan, thereby achieving the same operation as what is called frame inversion driving. For this reason, the applied voltage Vs has target values (+) and target values (−). The applied voltage VS corresponds to the display data OSD and ODD output from the operational unit 32 shown in FIG. 1. In the following description, the levels of the applied voltage VS will be expressed in terms of the absolute values of the applied voltage VS.

Initially, image data corresponding to a maximum transmittance is supplied for the frame period FL1. In the first subfield SF1 of the frame period FL1, the source driver 16 shown in FIG. 1 outputs to the liquid crystal panel 20 an applied voltage VS higher than the target value according to the exceeded display data OSD determined by the first operational unit 32*a* (FIG. 2(*a*)). The transmittance of the liquid crystal cell goes up and exceeds the target value during the subfield SF1 (FIG. 2(*b*)). That is, an overshoot operation is performed in the subfield SF1.

Next, in the subfield SF2 (last subfield) of the frame period FL1, the source driver 16 outputs an applied voltage (exceeded applied voltage) VS slightly lower than the target applied voltage according to the target display data ODD determined by the third operational unit 32*c* (FIG. 2(*c*)). The transmittance of the liquid crystal cell changes to the target value during the subfield SF2 (FIG. 2(*d*)). That is, an overdrive operation is performed in the subfield SF2.

Incidentally, the maximum value of the transmittance for a still image is set to the target transmittance of the frame period FL1. That is, in displaying a still image, the highest transmittance is set to a value below the maximum value of the transmittance of the liquid crystal cells. Consequently, image data corresponding to the maximum transmittance can be displayed with no differences in luminance between moving images and still images.

Next, image data to decrease the transmittance as compared to the image displayed in the frame period FL1 is supplied for the frame period FL2. In the first subfield SF1 of the frame period FL2, the source driver 16 outputs to the liquid crystal panel 20 an applied voltage VS lower than the target applied voltage according to the exceeded display data OSD determined by the first operational unit 32*a* (FIG. 2(*e*)). The transmittance of the liquid crystal cell goes down and reaches below the target value during the subfield SF1 (FIG. 2(*f*)). That is, an overshoot operation is performed in the subfield SF1.

Next, in the subfield SF2 (last subfield) of the frame period FL2, the source driver 16 outputs an applied voltage (exceeded applied voltage) VS slightly higher than the target applied voltage according to the target display data ODD determined by the third operational unit 32*c* (FIG. 2(*g*)). The transmittance of the liquid crystal cell changes to the target value during the subfield SF2 (FIG. 2(*h*)). That is, an overdrive operation is performed in the subfield SF2.

Incidentally, in each single frame period, the operational unit 32 generates the exceeded display data OSD and the target display data ODD so that the time integral of the actual transmittance and the time integral of the target value of the transmittance become equal. In other words, the operational unit 32 generates the exceeded display data OSD and target display data ODD so that the transmittance in a single frame period averages the target value. Specifically, in the frame period FL1, the sizes of the regions "A1" and "A2" bordered by the transmittance curve and the target value are equal to each other. In the frame period FL2, the sizes of the regions "B1" and "B2" bordered by the transmittance curve and the target value become equal to each other.

Adjusting the time integral of the transmittance in a single frame period to the target value can achieve constant hues in displaying moving image data, resulting in improved display properties of moving images.

Figure 3:
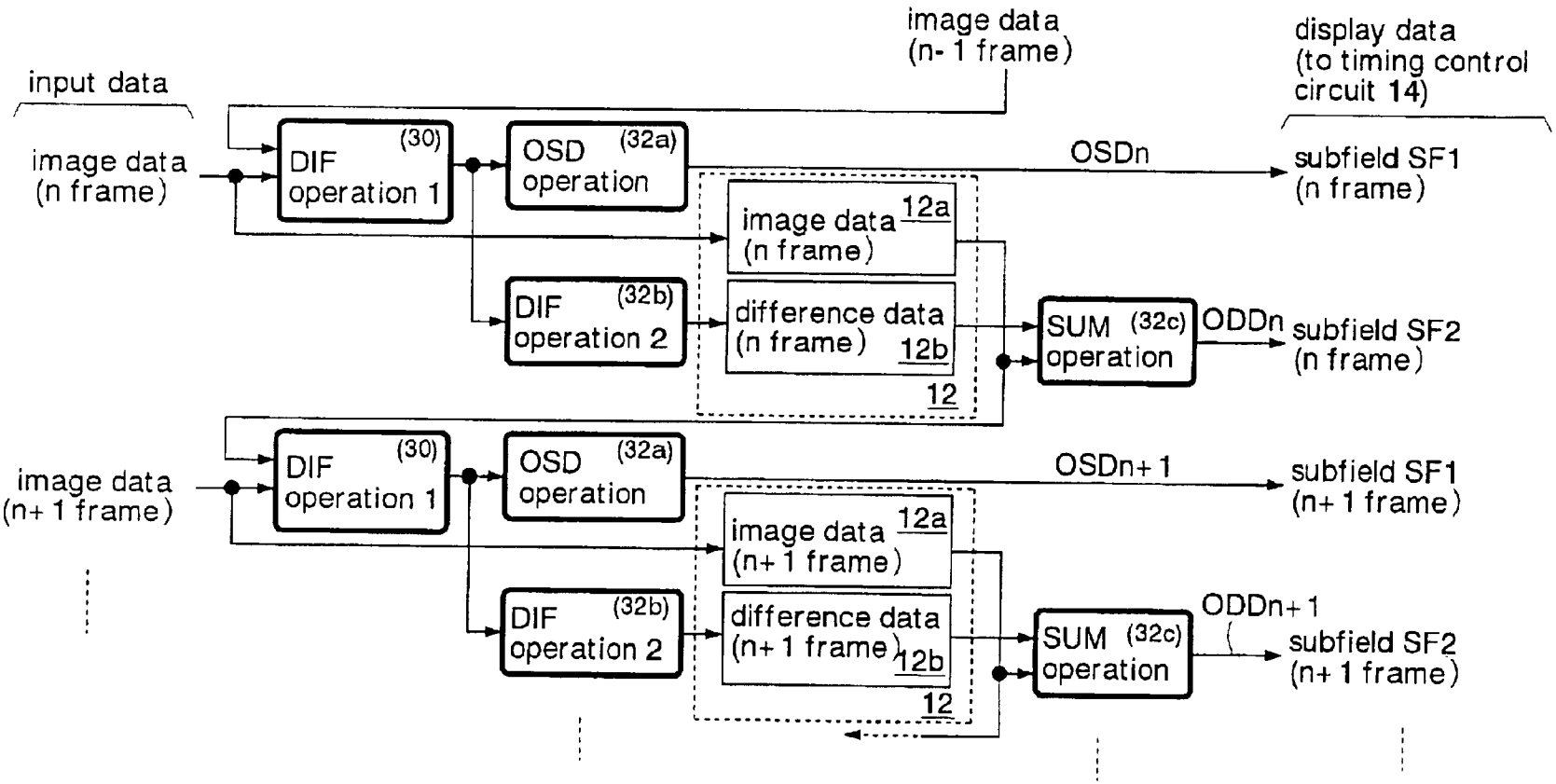
FIG. 3 is an explanatory diagram showing an overview of operation of the data conversion part in FIG. 1.

FIG. 3 shows an overview of operation of the data conversion part 10 shown in FIG. 1. In the diagram, the boxes shown in thick frames represent operations of the data conversion part 10, and the numerals in the boxes the circuits to perform the operations of the boxes.

For example, in an nth frame period, the data comparison unit 30 calculates differences DIFn between image data (n−1 frame) stored last time in the first memory unit 12*b* and image data of n frame supplied anew (difference operation 1). The first operational unit 32*a* calculates overshoot values according to the differences DIFn (OSD operation), and outputs the calculations as exceeded display data OSDn. The exceeded display data OSDn is used to generate the applied voltages VS for the subfield SF1 of n frame. The image data of n frame supplied anew is overwritten to the data memory unit 12*a* of the frame memory 12.

The second operational unit 32*b* calculates differences between overdrive values and the target values according to the differences DIFn, and stores the differences into the first memory unit 12*b* of the frame memory 12 as difference data (difference operation 2). The third operational unit 32*c* calculates the sum of the image data stored in the first memory unit 12*b* of the frame memory 12 and the difference data, thereby restoring the overdrive values for use in the subfield SF2 and outputting them as target display data ODDn.

The same operations as described above are also performed in the frame periods subsequent to the nth, whereby the exceeded display data OSD for the subfield SF1 and the target display data ODD for the subfield SF2 are generated in succession.

As has been described, in the present embodiment, an overshoot operation and an overdrive operation are performed in a single frame period so that each pixel is changed to the transmittance corresponding to the image data. It is therefore possible to avoid trails in moving image display. In particular, trails resulting from overshoot operations can be avoided. In other words, overshoot operations causing no trail can be made at the same frame rates as heretofore.

Since the transmittance of each pixel changes to its target value within a single frame period, it is possible to enhance the appearance of moving image display in any display pattern and improve the moving image display performance.

Performing an overdrive operation in the last subfield can ensure that each pixel changes to the transmittance corresponding to the image data within a single frame period.

The exceeded display data OSD and the target display data ODD such that an average of transmittance in a single frame period becomes almost equal to the target transmittance are generated. Consequently, moving image data can be displayed at constant hues with improved display properties of moving images.

The first and second operational units 32*a* and 32*b* correct the exceeded display data OSD and the target display data ODD, respectively, according to a temperature correcting value that is output from the temperature memory unit 26 in response to the ambient temperature detected by the temperature detecting unit 22. Consequently, optimum applied voltages VS can be supplied to the liquid crystal panel 20 all the time regardless of changes in the environment, allowing an improvement to the display quality of the liquid crystal panel 20.

The first and second operational units 32*a* and 32*b* correct the exceeded display data OSD and the target display data ODD, respectively, according to a rate correcting value that is output from the rate memory unit 24 according to the frame rate detected by the rate detecting unit 24. Consequently, optimum applied voltages VS can be supplied to the liquid crystal panel 20 all the time regardless of changes in frame rate, allowing an improvement to the display quality of the liquid crystal panel 20.

The display data for use in the last subfield SF2 is held in the first memory unit 12*b*, so that the operational unit 32 need not hold the display data. The operational unit 32 can thus be simplified in circuitry. Moreover, holding the display data in the form of differences can reduce the amount of data for the first memory unit 12*b* to hold. As a result, the first memory unit 12*b* can be made smaller in memory capacity.

The maximum value of the target transmittance is set to a value below the transmittance corresponding to the maximum value of the exceeded display data which the operational unit is able to output. Consequently, image data corresponding to the maximum transmittance can be displayed with no differences in luminance between moving images and still images. This can eliminate the differences in display properties between still images and moving images.

The periods of the subfields SF1 and SF2 are set to be equal to each other. This allows the operational unit 32 and the timing control unit 14 to operate under the same timing both in the subfields SF1 and SF2. The operational unit 32 and the timing control unit 14 can thus be simplified in circuitry.

Figure 4:
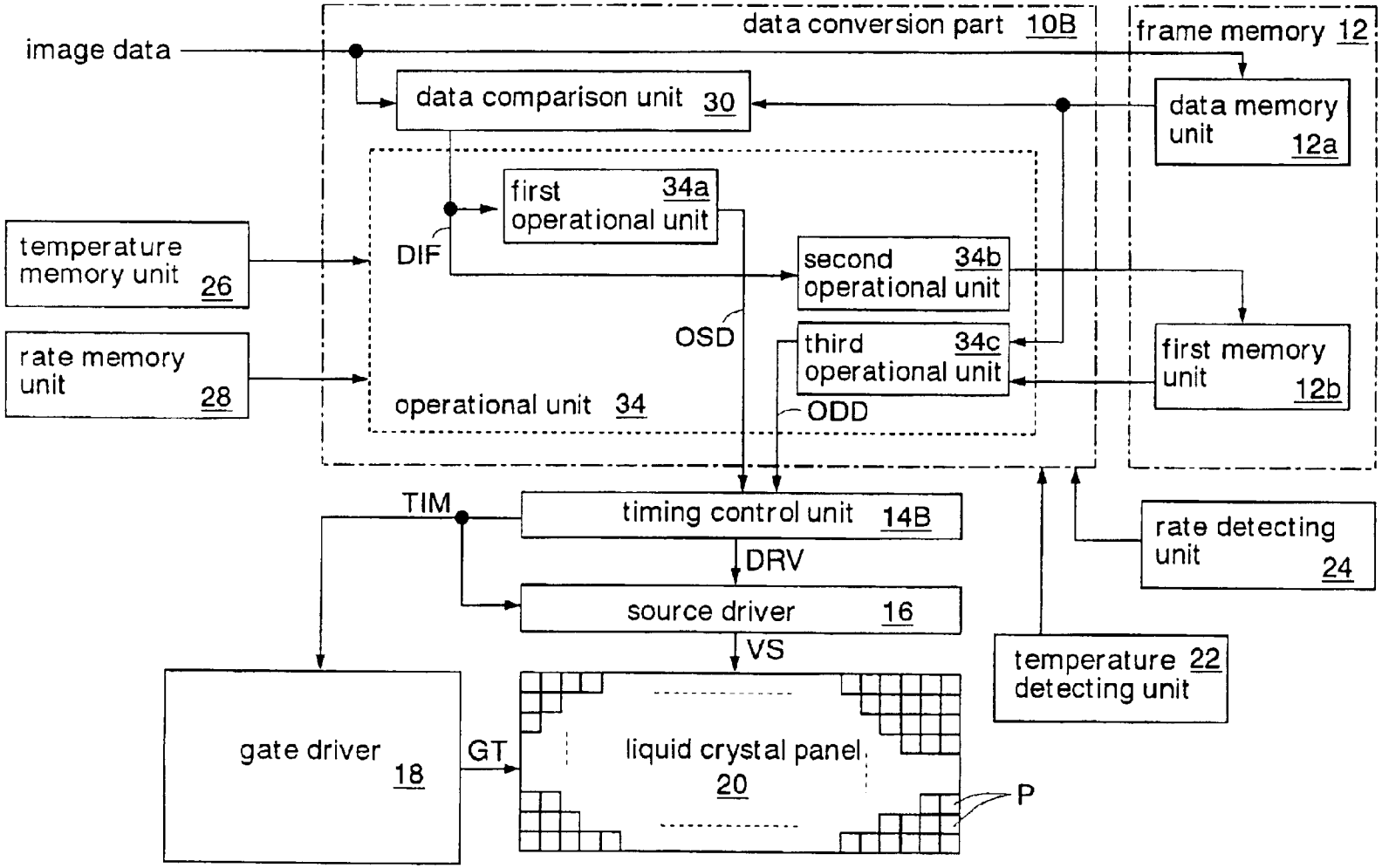
FIG. 4 is a block diagram showing a second embodiment of the present invention.

FIG. 4 shows a second embodiment of the display control device of a liquid crystal panel and the liquid crystal display device according to the present invention. The same elements as those described in the first embodiment will be designated by identical reference numbers. Detailed description thereof will be omitted.

This embodiment displays image data with the subfield SF1 made shorter than the subfield SF2 in period. For this reason, the data conversion part 10 and the timing control unit 14 of the first embodiment are replaced with a data conversion part 10B and a timing control unit 14B. The rest of the configuration is almost the same as in the first embodiment.

The data conversion part 10B is formed as an ASIC (Application Specific IC), and has a data comparison unit 30 and an operational unit 34. The operational unit 34 includes a first operational unit 34*a*, a second operational unit 34*b*, and a third operational unit 34*c*. The first operational unit 34*a*, second operational unit 34*b*, and third operational unit 34*c* are circuits corresponding to the first operational unit 32*a*, second operational unit 32*b*, and third operational unit 32*c* of the first embodiment, respectively. That is, the first operational unit 34*a* generates the exceeded display data OSD for the subfield SF1. The second and third operational units 34*b* and 34*c* generate the target display data ODD for the subfield SF2.

The timing control unit 14B successively receives the display data OSD and ODD from the first operational unit 34*a* and the third operational unit 34*c*, respectively, and outputs these display data OSD and ODD to the source driver 16 as driving signals DRV. Moreover, the timing control unit 14B generates a plurality of timing signals TIM for operating the source driver 16 and the gate driver 18 for the subfields SF1 and SF2 of different lengths, respectively.

Figure 5:
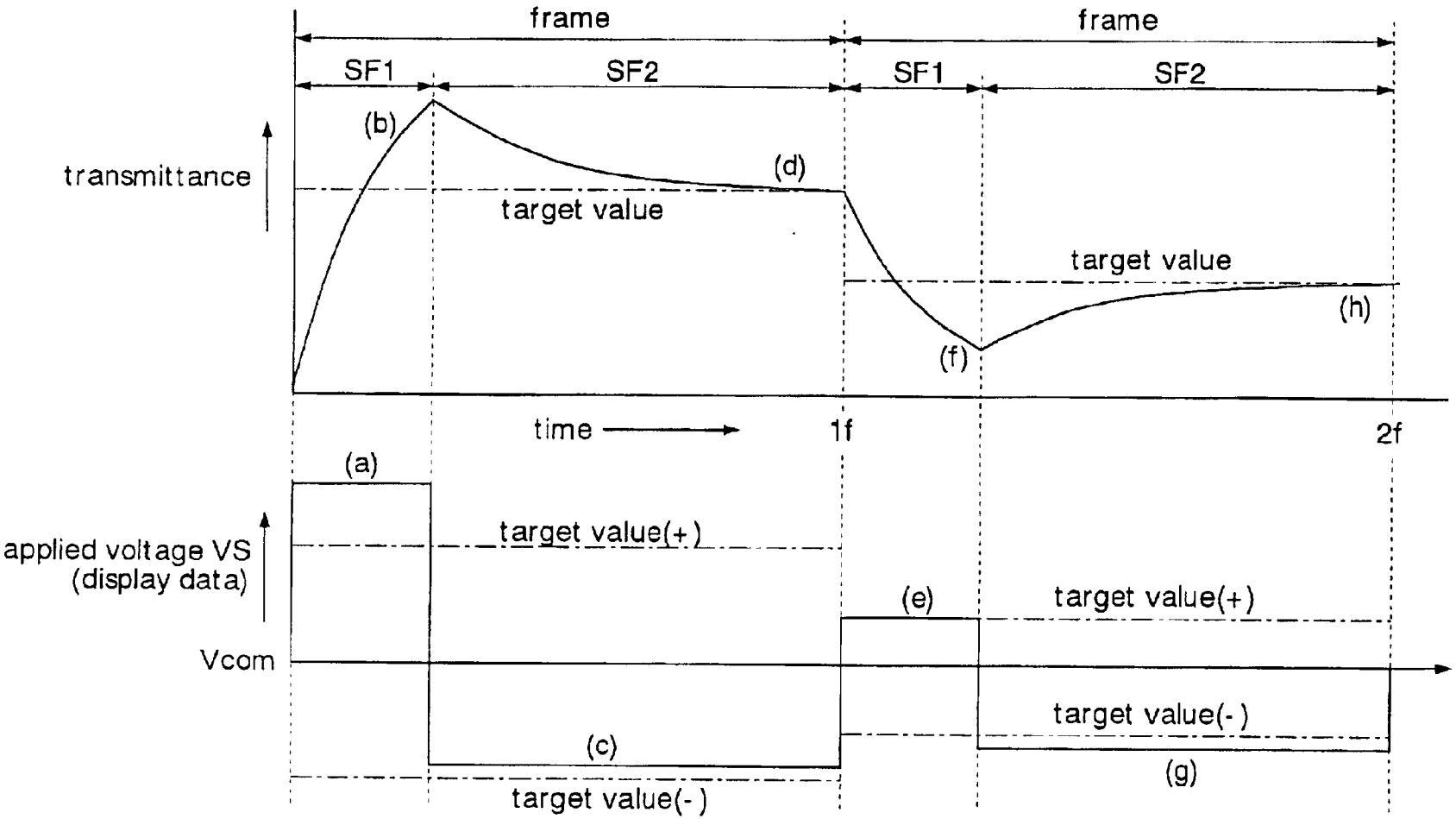
FIG. 5 is a timing chart showing how data is written to a pixel in the operation of the second embodiment.

FIG. 5 shows how a single pixel (liquid crystal cell) of the liquid crystal panel is written with data in the liquid crystal display device of the second embodiment. A difference from the first embodiment (FIG. 2) lies in that the period of the subfield SF1 is set to one-third the period of the subfield SF2. The rest of the operations are the same as in the first embodiment. In the diagram, (a)–(h) represent the operations corresponding to FIG. 2.

In this embodiment, the period of the first subfield SF1 is shortened so that the liquid crystal cells make quick changes in transmittance toward their target values after frame switching. Consequently, moving image data and still image data can be displayed at the same hues with improved display properties.

This embodiment can offer the same effects as those of the foregoing first embodiment. Besides, in the present embodiment, the shortened period of the first subfield SF1 allows the liquid crystal cells to make quick changes in transmittance toward their target values after frame switching. Moving image data and still image data can thus be displayed at the same hues with improved display properties.

Figure 6:
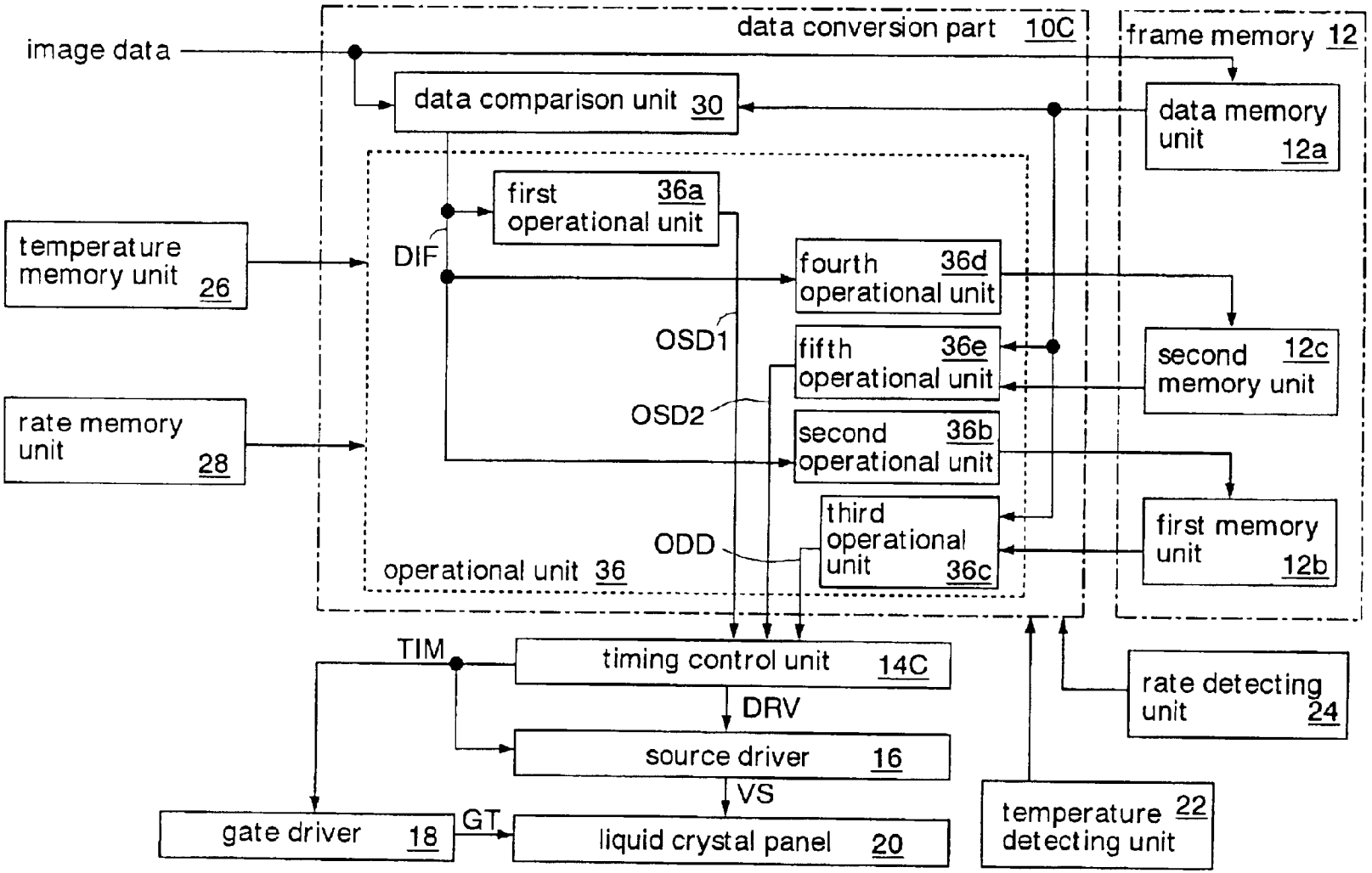
FIG. 6 is a block diagram showing a third embodiment of the present invention.

FIG. 6 shows a third embodiment of the display control device of a liquid crystal panel and the liquid crystal display device according to the present invention. The same elements as those described in the first embodiment will be designated by identical reference numbers. Detailed description thereof will be omitted.

In this embodiment, a single frame period is divided into three subfields SF1, SF2, and SF3. Overshoot operations are performed in the subfields SF1 and SF2, and an overdrive operation is performed in the last subfield SF3. For this reason, the data conversion part 10 and the timing control unit 14 of the first embodiment are replaced with a data conversion part 10C and a timing control unit 14C. The rest of the configuration is almost the same as in the first embodiment.

The data conversion part 10C is formed as an ASIC (Application Specific IC), and has a data comparison unit 30 and an operational unit 36. The operational unit 36 includes a first operational unit 36*a*, a second operational unit 36*b*, a third operational unit 36*c*, a fourth operational unit 36*d*, and a fifth operational unit 36*e*. The first operational unit 36*a*, second operational unit 36*b*, and third operational unit 36*c* are circuits corresponding to the first operational unit 32*a*, second operational unit 32*b*, and third operational unit 32*c* of the first embodiment, respectively. That is, the first operational unit 36*a* generates exceeded display data OSD1 for the first subfield SF1. The second and third operational units 36*b* and 36*c* generate the target display data ODD for the last subfield SF3.

The fourth and fifth operational units 36*d* and 36*e* are circuits for generating exceeded display data OSD2 for the second subfield SF2 (intermediate subfield). That is, the fourth operational unit 36*d* initially determines an overshoot value pixel by pixel based on the difference signal DIF from the data comparison unit 30. The fourth operational unit 36*d* determines a difference between the overdrive value determined and the target value corresponding to image data supplied anew, and writes the difference determined to a second memory unit 12*c* of the frame memory 12 as difference data.

The fifth operational unit 36*e* restores, in synchronization with the start of the subfield SF2, the overdrive values for use in the subfield SF2 from the image data stored anew in the data memory unit 12*a* after the comparison by the data comparison unit 30 and the difference data stored in the second memory unit 12*c*, and outputs them as exceeded display data OSD2.

The timing control unit 14C successively receives the display data OSD1, OSD2, and ODD from the first operational unit 36*a*, fifth operational unit 36*e*, and third operational unit 36*c*, respectively, and outputs these display data OSD1, OSD2, and ODD to the source driver 16 as driving signals DRV. Additionally, the timing control unit 14C generates a plurality of timing signals TIM for operating the source driver 16 and the gate driver 18 for the three subfields SF1, SF2, and SF3, respectively.

Figure 7:
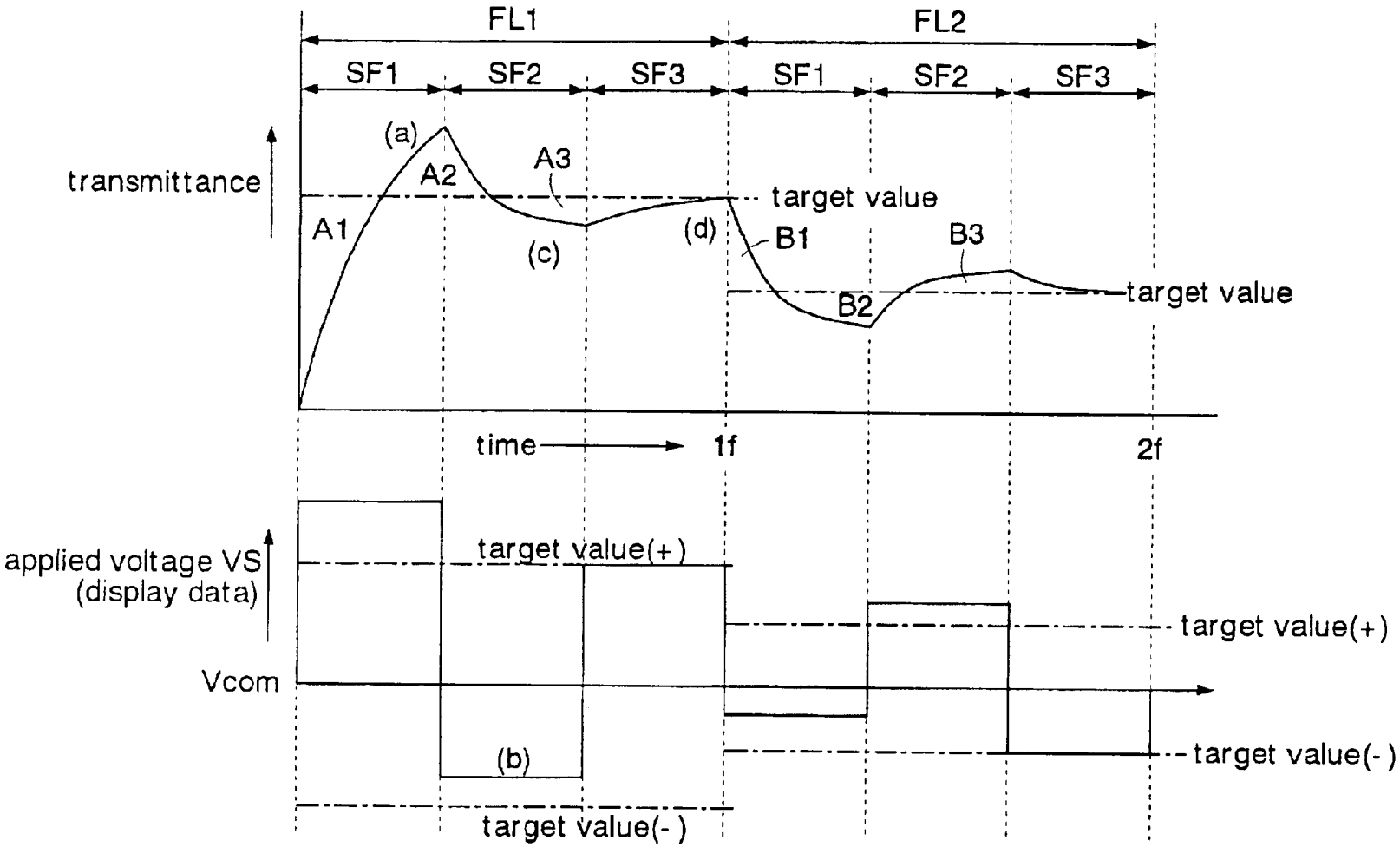
FIG. 7 is a timing chart showing how data is written to a pixel in the operation of the third embodiment.

FIG. 7 shows how a single pixel (liquid crystal cell) of the liquid crystal panel is written with data in the liquid crystal display device of the third embodiment. In this example, image data to increase the transmittance (e.g., data to increase luminance) is supplied for a frame period FL1, and image data to decrease the transmittance (e.g., data to decrease luminance) is supplied for a frame period FL2. Even in the present embodiment, the same operation as what is called frame inversion driving is performed. The applied voltage VS corresponds to the display data OSD1, OSD2, and ODD output from the operational unit 36 shown in FIG. 6. In the following description, the levels of the applied voltage VS refer to the absolute values of the applied voltage VS.

Initially, in the first subfield SF1 of the frame period FL1, an overshoot operation is performed as in the first embodiment, according to the exceeded display data OSD1. The transmittance of the liquid crystal cell goes up and exceeds the target value during the subfield SF1 (FIG. 7(*a*)).

Next, in the subfield SF2 of the frame period FL1, another overshoot operation is performed according to the exceeded display data OSD2. Here, the source driver 16 outputs to the liquid crystal panel 20 an applied voltage VS lower than the target value (FIG. 7(*b*)). The transmittance of the liquid crystal cell goes down and reaches below the target value during the subfield SF2 again (FIG. 7(*c*)).

Next, in the subfield SF3 (last subfield) of the frame period FL1, an overdrive operation is performed as in the first embodiment. The transmittance of the liquid crystal cell changes to the target value during the subfield SF3 (FIG. 7(*d*)).

In the frame period FL2, an overshoot operation is performed during the subfield SF1, an overshoot operation is performed during the subfield SF2, and an overdrive operation is performed during the subfield SF3 as described above.

In this way, a single frame period can be divided into three or more subfields to shorten the period of the first subfield SF1. The liquid crystal cells can thus make quick changes in transmittance toward their target values after frame switching. Consequently, moving image data and still image data can be displayed at the same hues with improved display properties.

Since the second or subsequent subfield involves an overshoot operation, the transmittance can be changed to both above and below the target value. On this account, the time integral of the actual transmittance and the time integral of the target value of the transmittance can be made identical in a single frame period. In other words, the average of transmittance in a single frame period can be easily matched with the target value. As a result, moving image data can be displayed at constant hues with improved display properties of moving images. Specifically, in the frame period FL1, the sum of the sizes of the regions "A1" and "A3" bordered by the transmittance curve and the target value becomes equal to "A2". In the frame period FL2, the sum of the sizes of the regions "B1" and "B3" bordered by the transmittance curve and the target value becomes equal to "B2".

Figure 8:
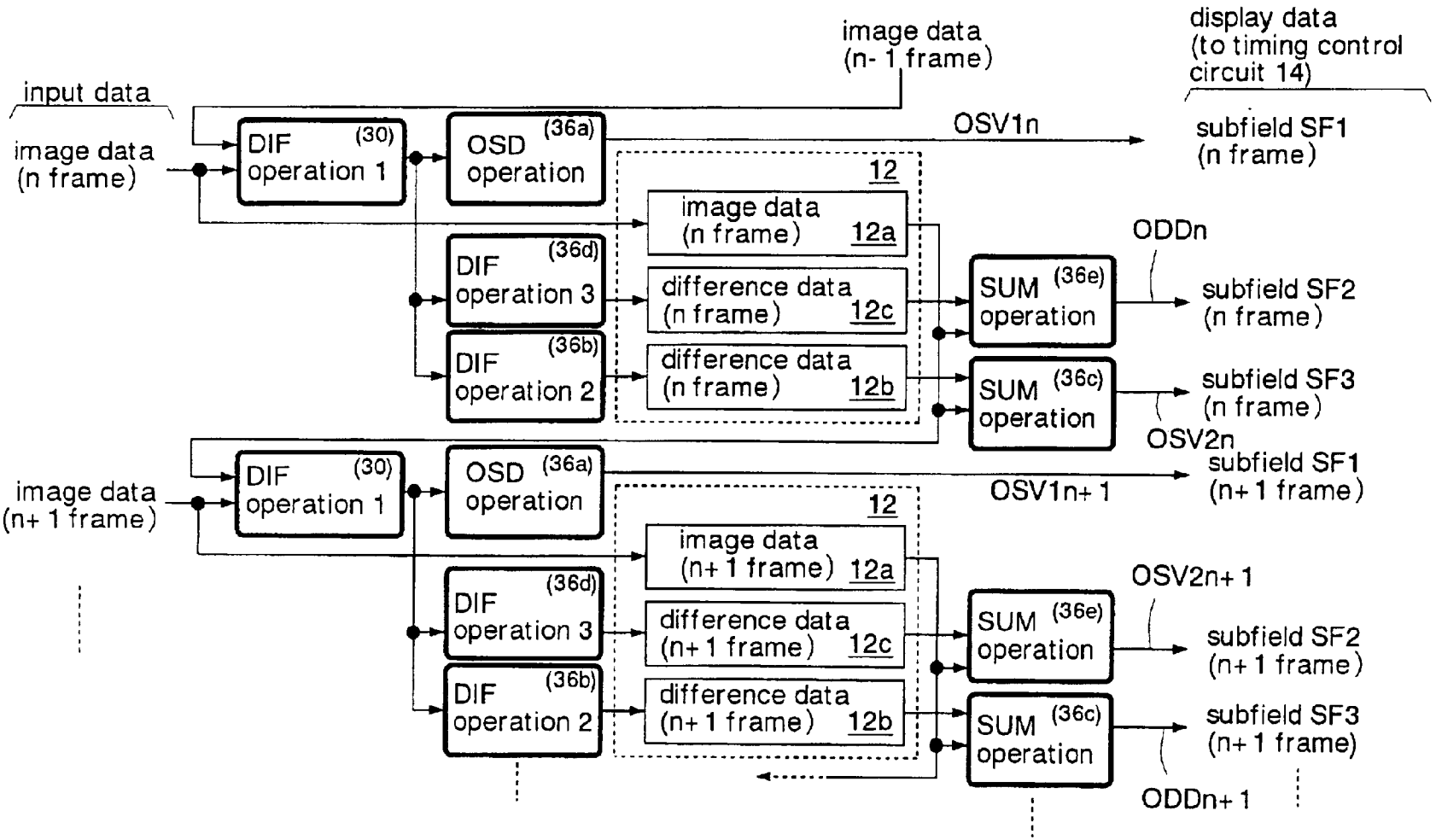
FIG. 8 is an explanatory diagram showing an overview of operation of the data conversion part in FIG. 6.

FIG. 8 shows an overview of operation of the data conversion part 10C shown in FIG. 6. In the diagram, the boxes shown in thick frames represent operations of the data conversion part 10C, and the numerals in the boxes the circuits to perform the operations of the boxes.

This embodiment differs from the first embodiment (FIG. 3) in the addition of the processing for performing overshoot operations for the second subfields SF2. That is, difference operations 3 and sum operations corresponding to the subfields SF2 are added. The rest of the processing is the same as in FIG. 3.

This embodiment can offer the same effects as those of the foregoing first embodiment. Besides, in this embodiment, the display data for use in the subfield SF2 is held in the second memory unit 12*c* so that the operational unit 36 need not hold the display data. The operational unit 36 can thus be simplified in circuitry. In addition, holding the display data in the form of differences can reduce the amount of data to be held. As a result, the second memory unit 12*c* can be made smaller in memory capacity.

Figure 9:
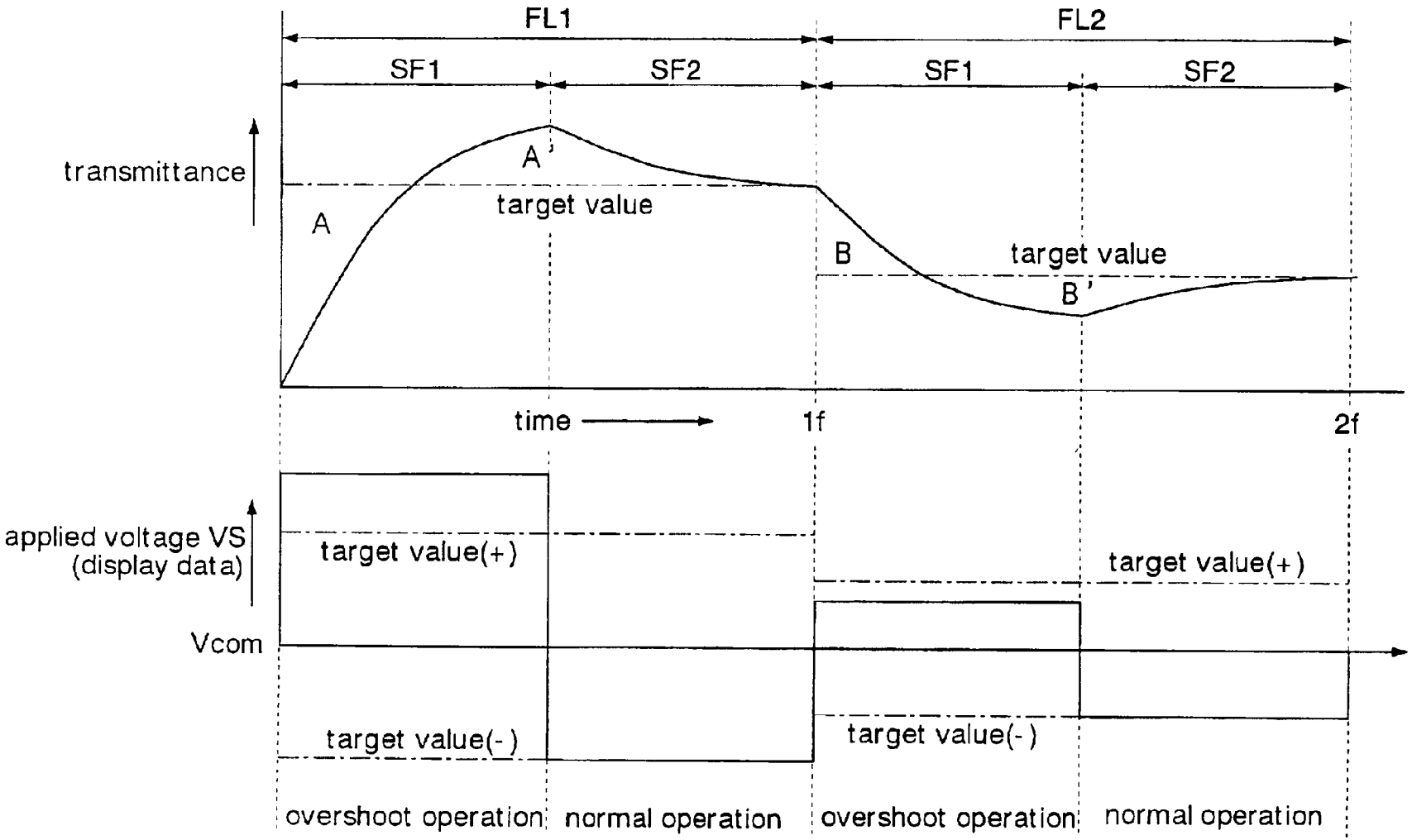
FIG. 9 is a timing chart showing another example of driving in the last subfields.

The foregoing first embodiment has dealt with the case where an overdrive operation is performed for the last subfield SF2. However, the present invention is not limited to such an embodiment. For example, as shown in FIG. 9, a normal operation of setting the applied voltage VS to a voltage corresponding to the target transmittance may be performed for the last subfield SF2. That is, an overshoot operation may be performed in the subfield(s) excluding the last subfield while a normal operation is performed in the last subfield.

The invention is not limited to the above embodiments and various modifications may be made without departing from the spirit and scope of the invention. Any improvement may be made in part or all of the components.

What is claimed is:

1. A display control device of a liquid crystal panel, comprising:

a data memory unit for storing image data to be supplied correspondingly to each single frame period for which a single frame of the liquid crystal panel is displayed;

a data comparison unit for determining, on each pixel of said liquid crystal panel, a difference between image data supplied anew and image data of a frame immediately preceding and stored in said data memory unit;

an operational unit for determining, for subfield(s) of a plurality of subfields other than a last subfield, based on said difference, exceeded display data for setting the transmittance of said each pixel to a value greater than a target transmittance corresponding to image data supplied anew, the plurality of subfields constituting said single frame period, and for determining, for said last subfield of said single frame period, based on said difference, target display data for setting the transmittance of said each pixel to said target transmittance; and a timing control unit for generating timing signals synchronizing with each of said plurality of subfields, receiving said exceeded display data and said target display data in succession from said operational unit, and outputting, in synchronization with said timing signals, driving signals of said liquid crystal panel according to the received display data.

2. The display control device of a liquid crystal panel according to claim 1, wherein said target display data which said operational unit determines for said last subfield corresponds to an exceeded applied voltage which exceeds a target applied voltage to be applied to said liquid crystal panel so as to set the transmittance of said each pixel to said target transmittance.

3. The display control device of a liquid crystal panel according to claim 2, further comprising a first memory unit, and wherein said operational unit includes a first operational unit for determining said exceeded display data corresponding to a first subfield of said single frame period, a second operational unit for determining, for said last subfield, a difference between said target display data corresponding to said exceeded applied voltage and display data corresponding to said target applied voltage, and for storing the determined difference into said first memory unit, and a third operational unit for determining said target display data corresponding to said exceeded applied voltage, according to said difference stored in said first memory unit and said image data stored in said data memory unit.

4. The display control device of a liquid crystal panel according to claim 3, further comprising a second memory unit, and wherein:

said single frame period includes three or more subfields; and said operational unit includes a fourth operational unit for determining, for intermediate subfield(s), a difference between display data corresponding to said target applied voltage and said exceeded display data, and for storing the determined difference into said second memory unit, the intermediate subfield(s) being of said single frame period other than said first and last subfields, and a fifth operational unit for determining said exceeded display data corresponding to said intermediate subfield(s), according to said difference stored in said second memory unit and said image data stored in said data memory unit.

5. The display control device of a liquid crystal panel according to claim 1, wherein said operational unit generates said exceeded display data and said target display data both of which allow an average of transmittance in said single frame period to be substantially equal to said target transmittance.

6. The display control device of a liquid crystal panel according to claim 1, wherein a maximum value of said target transmittance is smaller than a transmittance corresponding to a maximum value of said exceeded display data which said operational unit is able to output.

7. The display control device of a liquid crystal panel according to claim 1, wherein lengths of periods of said subfields are equal to each other.

8. The display control device of a liquid crystal panel according to claim 1, wherein a length of a period of said first subfield is shorter than lengths of periods of the rest of said subfields in said single frame period.

9. The display control device of a liquid crystal panel according to claim 1, comprising:

a temperature detecting unit for detecting an ambient temperature of said liquid crystal panel; and a temperature memory unit for storing temperature correcting values corresponding to individual ambient temperatures to be detected by said temperature detecting unit, and wherein said first and second operational units correct said exceeded display data and said target display data according to said temperature correcting values which are output from said temperature memory unit and correspond to the ambient temperatures detected by said temperature detecting unit.

10. The display control device of a liquid crystal panel according to claim 1, comprising:

a rate detecting unit for detecting a frame rate, which is said single frame period; and a rate memory unit for storing rate correcting values corresponding to frame rates to be detected by said rate detecting unit, and wherein said first and second operational units correct said exceeded display data and said target display data according to said rate correcting values which are output from said rate memory unit and correspond to the frame rates detected by said rate detecting unit.

11. A liquid crystal display device comprising:

a liquid crystal panel;

a data memory unit for storing image data to be supplied correspondingly to each single frame period for which a single frame of the liquid crystal panel is displayed;

a data comparison unit for determining, on each pixel of said liquid crystal panel, a difference between image data supplied anew and image data of a frame immediately preceding and stored in said data memory unit;

an operational unit for determining, for subfield(s) of a plurality of subfields other than a last subfield, based on said difference, exceeded display data for setting the transmittance of said each pixel to a value greater than a target transmittance corresponding to image data supplied anew, the plurality of subfields constituting said single frame period, and for determining, for said last subfield of said single frame period, based on said difference, target display data for setting the transmittance of said each pixel to said target transmittance; and a timing control unit for generating timing signals synchronizing with each of said plurality of subfields, receiving said exceeded display data and said target display data in succession from said operational unit, and outputting, in synchronization with said timing signals, driving signals of said liquid crystal panel according to the received display data.

* * * * *